US011007547B1

(12) United States Patent
Begis et al.

(10) Patent No.: US 11,007,547 B1
(45) Date of Patent: May 18, 2021

(54) PORTABLE PAINT BOOTH

(71) Applicant: Instant Auto Body, Lynnwood, WA (US)

(72) Inventors: Jacob Begis, Lynnwood, WA (US); Logan James Begis, Lynnwood, WA (US)

(73) Assignee: Instant Auto Body, Lynnwood, WA (US)

( * ) Notice: Subject to any disclaimer, the term of this patent is extended or adjusted under 35 U.S.C. 154(b) by 0 days.

(21) Appl. No.: 16/988,529

(22) Filed: Aug. 7, 2020

Related U.S. Application Data

(60) Provisional application No. 62/884,628, filed on Aug. 8, 2019.

(51) Int. Cl.
*B05B 16/60* (2018.01)
*B05B 16/80* (2018.01)
*B05B 16/40* (2018.01)

(52) U.S. Cl.
CPC ..... *B05B 16/60* (2018.02); *B05B 16/40* (2018.02); *B05B 16/80* (2018.02)

(58) Field of Classification Search
CPC ..... E04H 15/14; E04H 15/20; E04H 15/22
USPC ..... 454/50, 903
See application file for complete search history.

(56) References Cited

U.S. PATENT DOCUMENTS 1,811,529 A * 6/1931 Welch ..... A23B 7/152 99/476
2,032,103 A * 2/1936 Tise ..... F16L 9/003 138/119
2,172,130 A * 9/1939 Powell ..... A01G 25/00 138/110
2,516,869 A * 8/1950 Harris ..... E04H 15/44 135/126
2,649,101 A * 8/1953 Suits ..... E04H 15/22 52/2.16
2,939,378 A * 6/1960 Allen ..... B08B 15/02 454/63
2,976,797 A * 3/1961 Newbill ..... F23J 13/025 454/36
3,179,442 A * 4/1965 Lofgren ..... A47L 9/248 285/7
3,304,664 A * 2/1967 Duquette ..... E04H 15/22 52/2.26
3,651,609 A * 3/1972 Bird ..... E04H 15/22 52/2.25
3,719,030 A * 3/1973 Blankemeyer ..... B05B 16/40 95/286

(Continued)

FOREIGN PATENT DOCUMENTS

GB 2546828 A * 8/2017 ..... B08B 5/02

*Primary Examiner* — Edelmira Bosques
*Assistant Examiner* — Frances F. Hamilton

(57) ABSTRACT

A portable paint booth has a floor, roof and walls made of non-porous materials, at least one door, an air inlet adapted to receive air from a mechanical blower, and an exhaust tube that extends from the booth and comprises at least one orifice disposed at a terminal end of the tube, wherein the terminal end of the tube is disposed above a junction of a wall and the roof when the booth is pressurized. The exhaust tube may be supported by a pole to hold the tube upright and maintain a predetermined height. The terminal end of the tube may be propped open by a support element that extends around a perimeter of the exhaust tube.

17 Claims, 9 Drawing Sheets

(56) References Cited

U.S. PATENT DOCUMENTS 3,774,522 A * 11/1973 Marsh ..... A61G 13/108 454/187
3,857,209 A * 12/1974 Milliken ..... E04H 15/22 52/2.17
3,990,532 A * 11/1976 Robinson ..... E04G 21/28 180/164
4,041,653 A * 8/1977 Rain ..... E04H 15/22 52/2.19
4,158,462 A * 6/1979 Coral ..... F16L 27/0857 285/144.1
4,231,289 A * 11/1980 Domicent ..... B05B 16/40 454/52
4,477,503 A * 10/1984 Fraioli ..... E04H 15/22 428/102
4,719,935 A * 1/1988 Gustafson ..... E04H 15/10 135/124
4,800,690 A * 1/1989 Bunce ..... E04H 12/20 52/146
5,326,460 A * 7/1994 Cheesman ..... B01D 33/333 140/71 R
5,482,556 A * 1/1996 Shutic ..... B05B 13/0452 118/621
5,537,784 A * 7/1996 Baldwin ..... E04H 9/16 175/219
5,655,963 A * 8/1997 Paschke ..... F24F 13/068 454/297
5,769,702 A * 6/1998 Hanson ..... A61B 18/00 128/204.18
5,853,215 A * 12/1998 Lowery ..... B60P 3/14 296/24.32
6,058,660 A * 5/2000 Melton ..... E04H 6/04 411/281
6,132,509 A * 10/2000 Kuschnereit ..... B01D 29/27 118/64
6,318,394 B1 * 11/2001 Zheng ..... A63B 9/00 135/125
6,616,524 B2 * 9/2003 Storck, Jr. ..... F24F 7/06 361/678
6,655,097 B1 * 12/2003 Poolaw ..... E04G 21/26 248/188.1
6,679,009 B2 * 1/2004 Hotes ..... E04H 15/36 135/117
7,677,260 B2 * 3/2010 Sumner ..... E04H 15/14 135/117
7,735,502 B1 * 6/2010 Hotes ..... E04H 15/64 135/91
8,353,745 B1 * 1/2013 Rossnagel ..... F16L 11/11 454/65
8,458,966 B2 * 6/2013 O'Toole ..... E04H 17/22 52/146
9,771,729 B2 * 9/2017 Workman ..... E04H 15/56
9,776,223 B2 * 10/2017 Rankin ..... E04H 1/1277
10,124,376 B2 * 11/2018 Zucchi ..... B08B 15/02
10,717,103 B2 * 7/2020 Williams ..... B05B 16/60
10,766,049 B2 * 9/2020 Williams ..... E04H 5/02
2003/0015633 A1 * 1/2003 Pyanowski ..... H01Q 1/44 248/146
2006/0164825 A1 * 7/2006 Pippa ..... B05B 16/40 362/147
2007/0090629 A1 * 4/2007 Ohnstad ..... B62D 63/061 280/656
2008/0169013 A1 * 7/2008 Brockel ..... E04H 15/14 135/93
2009/0165401 A1 * 7/2009 Smalley, III ..... E04C 3/36 52/91.3
2010/0126545 A1 * 5/2010 Bullivant ..... E04H 15/36 135/125
2010/0272915 A1 * 10/2010 Laws ..... B05B 16/40 427/421.1
2011/0005560 A1 * 1/2011 Nair ..... E04H 15/14 135/96
2011/0021127 A1 * 1/2011 Giarrizzo, Jr. ..... B05B 14/30 454/51
2011/0023428 A1 * 2/2011 Ziebold ..... B01D 46/12 55/419
2012/0247311 A1 * 10/2012 Warner ..... E04H 9/04 89/36.01
2013/0266301 A1 * 10/2013 Hedenberg ..... E04H 15/22 396/1
2014/0235153 A1 * 8/2014 Rankin ..... F24F 1/02 454/63
2015/0040487 A1 * 2/2015 Wiliams ..... B05B 16/40 52/2.23
2016/0215512 A1 * 7/2016 Workman ..... E04B 1/34384
2017/0156961 A1 * 6/2017 Patel ..... A61G 10/005
2019/0015861 A1 * 1/2019 Mariani ..... B05B 16/80
2020/0056396 A1 * 2/2020 Fraioli ..... E04B 1/34384
2020/0102766 A1 * 4/2020 Carter ..... E04H 15/14

* cited by examiner

PORTABLE PAINT BOOTH

RELATED APPLICATION

This application claims the benefit of U.S. Provisional Application No. 62/288,4628, filed Aug. 8, 2019, which is incorporated herein by reference in its entirety.

BACKGROUND

Automotive spray-painting is a sensitive process that requires a controlled environment to be safe and effective. Automotive paint is typically transported by a solvent medium, and the solvents can be highly volatile and hazardous to human health when inhaled. Unlike latex paint, automotive paints often undergo catalytic reactions to create a hard finish that is resistant to damage from debris encountered when driving. The hardened finish can also be very difficult to remove and possibly toxic, so overspray from automotive finishes present hazards that are not present in latex or oil-based exterior paints. In addition, automotive finishes are highly sensitive to particulate contamination—even small dust particles can create visible flaws in a painted surface.

In order to address these challenges, automotive painting has conventionally been conducted in highly controlled buildings. Indoor painting spaces can be controlled to manipulate airflow to ensure that painting spaces are well ventilated, dust-free and easily cleaned. For example, some indoor systems have porous floor grates that prevent the accumulation of dust and debris, and can have sophisticated air handling systems to remove fumes and spray particles. These controls have facilitated industrial-scale spray painting with high throughput.

However, it is not always practical to transport vehicles to a static spray booth. In many circumstances, it is challenging to transport a vehicle to a remote location to be painted. Some vehicles are not in an operational state, and in some circumstances multiple vehicles are in a single physical location, so that it is desirable to perform painting at the location of a vehicle instead of moving the vehicle to a stationary painting booth.

Others have attempted to provide an effective portable spray booth. For example, U.S. Pub. No. 20100272915 describes an inflatable structure that can be transported to a job site and erected by inflating tubular struts. However, the structure described by that document is heavy, complex and expensive. Relying on an operating blower as the source of structural support can be problematic when power is unexpectedly terminated. The structure would be bulky and heavy, so it would be difficult to transport and assemble. The inflatable structure is relatively large, which may trigger requirements for a fire suppression system in certain jurisdictions. In addition, the inflatable system implements down-draft airflow—while downdraft airflow is effective for a booth with a porous or grated floor, it can problematically stir up dust and particles on a solid floor, contaminating the painting environment.

BRIEF SUMMARY

Embodiments of the present disclosure relate to a spray booth that can be disassembled, transported, and re-assembled at a different location. Accordingly, the spray booth may comprise elements of a tent pole structure, including a floor, walls and roof that are made of flexible materials, and a support structure that can be detached from the floor, walls and roof. The spray booth may have an exhaust tube that extends from the main body of the spray booth and exhausts air from the spray booth so that the exhausted air escapes to atmosphere, and reduces the probability of the escaped air re-entering the booth.

In an embodiment, a portable paint booth has a floor, a roof, four walls, at least one door disposed in a front wall of the booth, an air inlet adapted to receive air input into the spray booth from a mechanical blower, an exhaust tube that extends from the booth and comprises at least one orifice disposed at a terminal end of the tube, and the terminal end of the tube is disposed above a junction of a side wall and the roof when the booth is pressurized.

In an embodiment, the exhaust tube comprises a first section that extends horizontally from a wall of the booth, a second section directs the exhausted air to a vertical axis, and a third section that conveys the exhausted air along the vertical axis to exit through the terminal end of the tube. An embodiment may include a support pole that vertically supports the exhaust tube, wherein the support pole is coupled to and extends along an entire length of the third section of the exhaust tube, and the support pole is anchored to a stable structure.

The booth may have a support system that supports the third section of the exhaust tube, the support system comprising at least one perimeter element that extends around a perimeter of the exhaust tube and maintains a portion of the exhaust tube in an open orientation.

The at least one perimeter element may have three or more perimeter elements that are spaced apart from one another. A body of the exhaust tube may include a flexible polymeric material. A support system may be coupled to the exhaust tube, and the support system may have at least one perimeter element disposed at the terminal end of the tube, wherein the perimeter element extends around a perimeter of the tube and keeps the terminal end of the tube in an open orientation. In an embodiment, the exhaust tube extends at least six feet above the highest point of the roof.

In an embodiment, the floor, the roof and the walls of the booth comprise flexible polymeric materials, and the roof and walls are supported by rigid poles. The roof may be separable from the walls, and the walls may be separable from the floor. The air inlet may be an air inlet assembly that includes an inlet filter compressed between two mesh panels.

In an embodiment, the exhaust tube is coupled to a manifold comprising an inner layer and an outer layer of the first side of the booth, and an entrance to the manifold is an exhaust port in the inner layer. The exhaust port may have at least one filter compressed between two mesh panels, and a selective blocking element that can be adjusted to selectively block a portion of the exhaust port. In an embodiment, the floor, the roof and the walls all comprise non-porous materials so that the tent inflates with air when the mechanical blower is in operation and the air exits the paint booth through the terminal end of the exhaust tube.

The exhaust tube may have a cylindrical shape, and the terminal end of the exhaust tube may include a sheet of material having a plurality of orifices through which air exits the exhaust tube. In an embodiment, the booth may have at least one front door and a side door, and the floor occupies an area of 400 square feet or less. A booth may have a side cover with a first end that is coupled to the booth above the side door and a free end opposite to the first end. The air inlet and the side door may be disposed at a second side wall on an opposite side of the paint booth from the first side wall.

Figure 1:
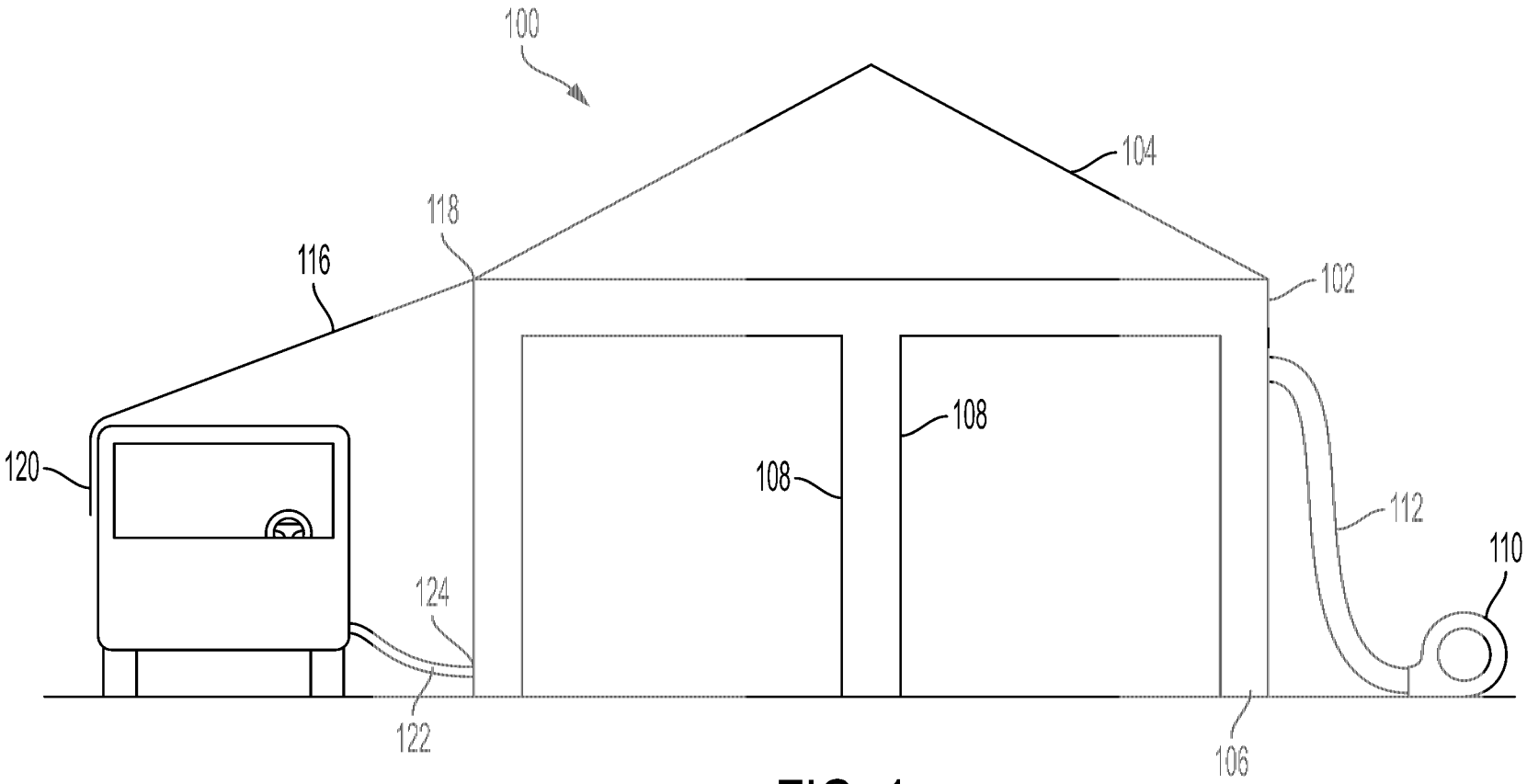
FIG. 1 is a front view of a portable paint booth.

The drawings have not necessarily been drawn to scale. Moreover, while the technology is amenable to various modifications and alternative forms, specific embodiments have been shown by way of example in the drawings and are described in detail below. The intention, however, is not to limit the technology to the particular embodiments described. On the contrary, the technology is intended to cover all modifications, equivalents, and alternatives falling within the scope of the technology as defined by the appended claims.

DETAILED DESCRIPTION

A detailed description of embodiments is provided below along with accompanying figures. The scope of this disclosure is limited only by the claims and encompasses numerous alternatives, modifications and equivalents. Numerous specific details are set forth in the following description in order to provide a thorough understanding. These details are provided for the purpose of example and embodiments may be practiced according to the claims without some or all of these specific details. For the sake of clarity, technical material that is known in the technical fields related to this disclosure has not been described in detail so that the disclosure is not unnecessarily obscured.

Autobody painting is a highly skilled and specialized profession that can take many years to master. Even organizations that have regular needs for automotive body painting typically find that it is more economical to contract automotive painting services to painting specialists. Fleet operators and automotive dealerships rarely require entirely new paint jobs for vehicles—it is far more typical to repair scratches and repaired body panels, and it is more economical to use painting contractors for these services.

Car dealerships and fleet operators often have mechanical repair facilities on-site, but rarely have painting facilities. Conventionally, this problem has been addressed by erecting quasi-permanent structures. For example, small pole buildings or large sheds can be adapted to provide an environment that is suitable for automotive painting. However, these structures often run afoul of local building codes and tend to be unsightly and expensive. Furthermore, some facilities simply lack the space to dedicate to such structures, which are difficult to construct and dismantle.

Portable spray booths solve many of these issues. A portable spray booth is a structure that can be quickly assembled and disassembled at a location by a limited number of personnel and is easily transported between locations, preferably within a painter's work vehicle. For example, embodiments of the present application can be assembled in on or two hours by a single person, and can be packed alongside painting equipment within a work van.

FIG. 1 illustrates a front view of an embodiment of a portable spray booth 100. The tent has body comprising walls 102, a roof 104, and a floor 106, each comprising a flexible polymeric material. The specific materials used for the floor, roof and walls may be different from one another. Examples of flexible polymeric materials include homogenous polymer sheets, such as polyurethane sheets, polymer impregnated fabrics, and multi-layer laminates of different polymers and/or fabrics. In addition, the flexible polymeric materials may have a property such as waterproofness, chemical resistance, vapor barrier, fire-retardancy, UV resistance and thermal insulation. A metallized layer or metallic elements may be present in a flexible polymeric material.

The material used for the floor 106 may be different from the materials used for the walls 102 and roof 104. In particular, the floor material may be robust enough to withstand abrasion that could be encountered on a gravel or asphalt surface. In addition, the floor material may be dark and opaque so that dust, dirt and other foreign matter is highly visible.

In order to reduce weight and increase ease of transportation and assembly, the walls may be constructed of a flexible polymeric material that is lighter weight than the floor material. In addition, the wall material may be a translucent material so that the interior of the booth 100 can be illuminated by external light sources. For ease of assembly, the floor may be a separate article from the walls, and may attach to the walls by a fastener. Examples of fasteners of the doors are zippers, which may be heavy gauge or sealing zippers, hook-and-loop materials, magnets, and a combination of these fasteners. In a specific embodiment, the walls are fastened to the floor sheet by a 2 inch hook-and-loop strip provide around the perimeter of the floor.

The roof may also comprise a flexible polymeric material, and the material used for the roof may be lighter weight than the wall and floor materials. The inventors have found that using a lighter weight material for the roof eases assembly of the booth, and facilitates assembly of the paint booth by a single individual. In addition, the roof material may be more translucent than the wall or floor material to pass light from overhead sources. In some embodiments, the roof material may be translucent, or include one or more translucent panel.

The roof may be a separate component from the walls, and coupled to the wall material by, for example, a zipper and/or hook-and-loop attachment. A separable roof component aides the assembly of the booth and facilitates assembly by a single operator.

The embodiment shown in FIG. 1 has two front doors 108. The front doors may be large enough to accommodate a typical vehicle, so that the booth 100 can simultaneously accommodate two vehicles. The doors may be constructed of a flexible fabric material that is the same material for the walls. Although the embodiment shown in FIG. 1 has two doors, other embodiments may have a single door or three or more doors.

The doors may be attached to the body of the spray booth to limit the amount of air that escapes around the perimeter of the doors. A top of the doors may be integrated with the walls, while the sides and base of the doors may be detachable by fasteners. In one specific embodiment, the front doors are attached to the walls with #10 (heavy duty) zippers on the sides and a 2-inch hook-and-loop fastener strip at the base.

A blower 110 is coupled to a side of the spray booth 100 through an input duct 112 that is external to the booth. The duct is not particularly limited in shape, and transports air from the blower into the spray booth. The blower 110 may be, for example, a 1, 2 or 3 hp blower. In some embodiments, more than one blower 110 is coupled to the booth. Although FIG. 1 shows the blower 110 on the right side of the booth, in another embodiment, the blower is on the same side of the booth as the side cover 116.

The size and number of blowers and corresponding ducting may be selected along with several additional factors in order to achieve one or more conditions inside of the booth 100, including providing five or more air turns per hour within the booth. Variables that affect the flow through the booth include size and types of filters at inlets and outlets of the booth, the total volume inside the booth, the velocity and volume of air output from the blower, and the amount of restriction provided by inlet and outlet ports.

In some embodiments, the spray booth 100 may be referred to as an inflatable spray booth. An inflatable spray booth may be a booth which is pressurized by forced air input into the booth so that the booth is pressurized by the air, and the majority of the air that escapes from the booth is directed towards one or more outlet. For example, in some embodiments, 90%, 95%, 98%, 99% or more of the air that escapes an inflated booth is directed through the one or more exhaust port 160, and exits through at least one exhaust port 128. Accordingly, seams of the of an inflatable spray booth may be structured to restrict air from escaping, and materials of the booth may have low or no porosity.

In the embodiment shown in FIG. 1, the input duct 112 enters a wall of the booth 100 through an air inlet 114 located above a midpoint of the booth, which can help avoid blowing air onto the floor of the booth. In other embodiments, the input duct 112 between the blower and the booth may enter the booth at a lower level, and a configuration of the air inlet 114 inside the booth may limit stirring debris on the floor of the booth.

The input duct 112 terminates at an air inlet 114, which may retain a first filter 148. The inlet box may comprise a flexible polymeric material, and may provide access to the first filter by a closure mechanism such as a hook-and-loop closure or a zipper. The filter may be a dust or particle filter that prevents dust and other foreign particles from being introduced into the booth. For example, the filter may be a 20"×20" intake panel filter as known in the art.

FIG. 1 shows a painter's work vehicle on the opposite side of the booth 100 from the blower 110. The space between the work vehicle and the booth is covered by a side cover 116, which can shelter a painter from the elements when the painter moves between the work vehicle and the booth. The side cover 116 may have a first end 118 that is coupled to the booth, and a second end that is a free end 120 that can be positioned over the vehicle. The free end 120 may have one or more hole or strap that can be used to secure the free end to the vehicle.

In an embodiment, the free end 120 includes one or more magnetic strip that magnetically couples to the roof of the vehicle. In another embodiment, the free end has at least two holes that interface with ratcheting tie-down straps that apply tension to secure the side cover 116 to the vehicle. In addition, the booth 100 may include one or more strap to secure the side cover when not in use. In some embodiments, the side cover may be detachable from the body of the booth.

A hose 122 extents between the vehicle and the booth 100. The hose 122 may be an air hose that supplies pressurized air from a compressor inside the vehicle to a paint gun inside the booth. The booth may include one or more hose port 124 that allows the hose 122 to pass through the wall of the booth while limiting porosity of the booth.

Figure 2:
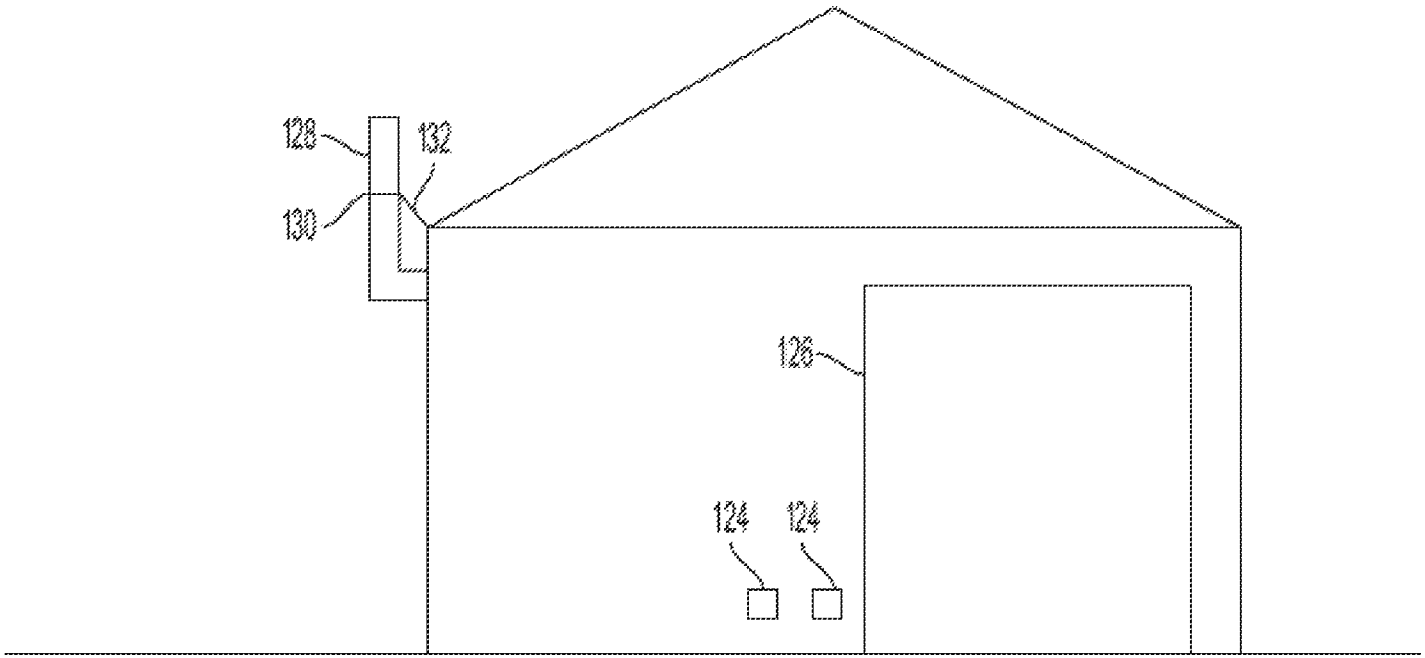
FIG. 2 is a side view of a portable paint booth.

FIG. 2 illustrates a side view of a portable spray booth 100. Two hose ports 124 are shown in the embodiment of FIG. 2, but other embodiments may include more or less than two ports. The ports may include a cover that is securable to the booth, e.g. by hook and loop fasteners, to block the ports when not in use. In addition, the ports may include an orifice, which may be outfitted with a grommet or elastomeric element, through which a hose 122 can pass.

A side door 126 is disposed in the spray booth, and positioned to provide convenient access to a painter for loading and unloading equipment into the booth. The side door may have similar characteristics to the front doors shown in FIG. 1.

Also shown in FIG. 2 is an exhaust tube 128 that extends from a rear wall of the booth. The exhaust tube 128 is secured to the booth by one or more strap 132 which may stabilize the orientation of the exhaust tube 128 with respect to the booth. The exhaust tube may be constructed of materials having sufficient rigidity to maintain its shape, and positive pressure within the tube may provide additional structural stability when the booth is in operation. However, the tube may be constructed of flexible polymeric material to reduce weight and support portability, and the tent walls are generally constructed of flexible polymeric materials. Accordingly, one or more strap 132 may be helpful to stabilize the exhaust tube in the presence of wind or other external forces.

The strap 132 may comprise a flexible material such as a polymer sheet or a webbing material. In another embodiment, the strap is a rigid material such as a rigid polymer, aluminum, etc. The strap may stabilize the exhaust tube in directions orthogonal and parallel to the plane of the back wall. Accordingly, the straps may form an acute angle with respect to a horizontal component of the back wall. In addition, the straps may have an acute angle with respect to the vertical plane to maintain a vertical orientation of the exhaust tube 128.

The strap 132 may interface with the exhaust tube 128 through a collar 130 that extents around an exterior of the exhaust tube. The collar 130 may be a rigid or flexible material such as a metal ring or a length of webbing. The exhaust tube may be fixedly attached to the collar by an adhesive bond or stitches, removably attached by hook and loop surfaces, or retained by frictional forces without any mechanical attachments. The collar 130 may be fixedly or removably attached to the strap 132. In an embodiment, the collar is disposed above the lower edge of the roof of the booth to support a portion of the exhaust tube that extends above the lower edge of the roof.

Although a single strap 132 is shown in the figure, other embodiments are possible. For example, another embodiment may have two straps that are symmetrically arranges on left and right sides of the exhaust tube 128 with respect to the back wall of the booth.

In another embodiment, the vertical part of exhaust tube 128 is secured to a wall of the spray booth 100 at one or more securement point oriented along the vertical axis of the tube. For example, the tube may have one or more loop or strap extending from a side that faces the portable booth, and that loop or strap may be securable to a corresponding loop or strap on the back wall of the tent. In still another embodiment, one or more strap extends from the back wall of the portable booth.

Figure 3:
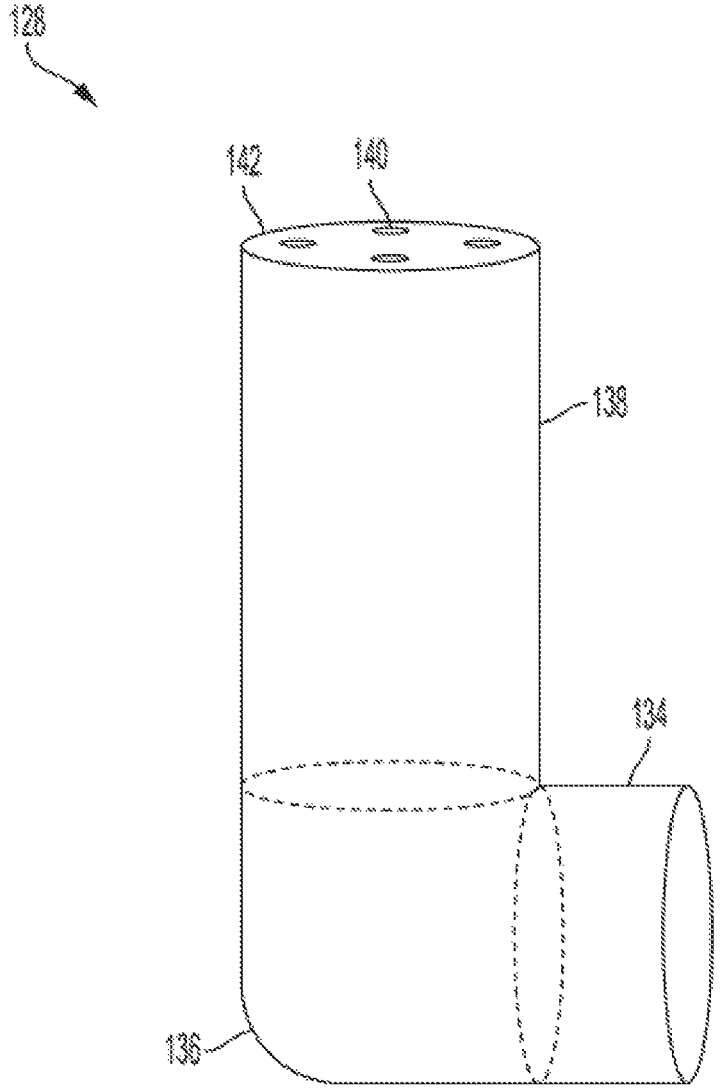
FIG. 3 illustrates an exhaust tube.

FIG. 3 illustrates an embodiment of the exhaust tube 128 in isolation from the booth. The tube 128 has three sections—a first section 134 that interfaces with the booth and extends the tube outwards from the booth, a second section 136 that is a 90 degree elbow that changes the air flow from a horizontal direction to a vertical direction, and a third section 138 that transports exhaust above a roofline of the booth to exhaust fumes from the booth to atmosphere.

The far end of the exhaust tube 128 is perforated with a plurality of openings 140 through which exhaust is ventilated to atmosphere. In such an embodiment, it is possible to cover one or more of the openings to restrict or permit flow out of the tube. However, embodiments are not limited to this orientation—for example, in another embodiment, a single opening 140 is present. The exhaust tube 128 shown in FIG. 3 is cylindrical, but other shapes are possible. For example, in other embodiments, the exhaust tube may have a square, rectangular or oval cross-sectional profile.

The exhaust tube 128 may be primarily constructed from a material that is the same as or similar to materials used for other parts of the spray booth. That is, the exhaust tube may comprise a flexible polymeric material. In particular, the exhaust tube may comprise a polymeric material that has chemical resistance to solvents used in paints. The material may have sufficient rigidity to retain its shape even when it is not inflated, while maintaining sufficient flexibility to be collapsed and folded for portability. In some embodiments, the material forming walls of the exhaust tube may be selectively reinforced, e.g. with metal or polymer wires or strips, to provide additional rigidity.

In an embodiment, the exhaust tube may have a diameter of about 8 inches, 10 inches or 12 inches or 16 inches. Within this range, the exhaust tube provides enough air flow to exhaust the space of the portable booth while providing enough restriction to pressurize and inflate the tube to maintain a vertical orientation in operation, even in the presence of wind.

Returning to FIG. 2, the terminal or distal end 142 of exhaust tube 128 is disposed above a roofline of the booth. In particular, the terminal end 142 is disposed above an upper edge of the walls of the booth where the walls 102 are coupled to the roof 106. In such an embodiment, fumes that are exhausted from the tube are exposed to an atmospheric plane that is not obstructed by the walls of the tent, which reduces the possibility that fumes would accumulate near the booth, and consequently reduces hazards associated with accumulated fumes. In some embodiments, the exhaust tube may terminate above the peak of the roof.

The tube may extend for several feet in the vertical dimension. For example, the tube may have a vertical height of 4 feet, 6 feet, 8 feet, 10 feet, or more. In some embodiments, the tube may extend 6 feet or more above the highest point of the roof.

Figure 4:
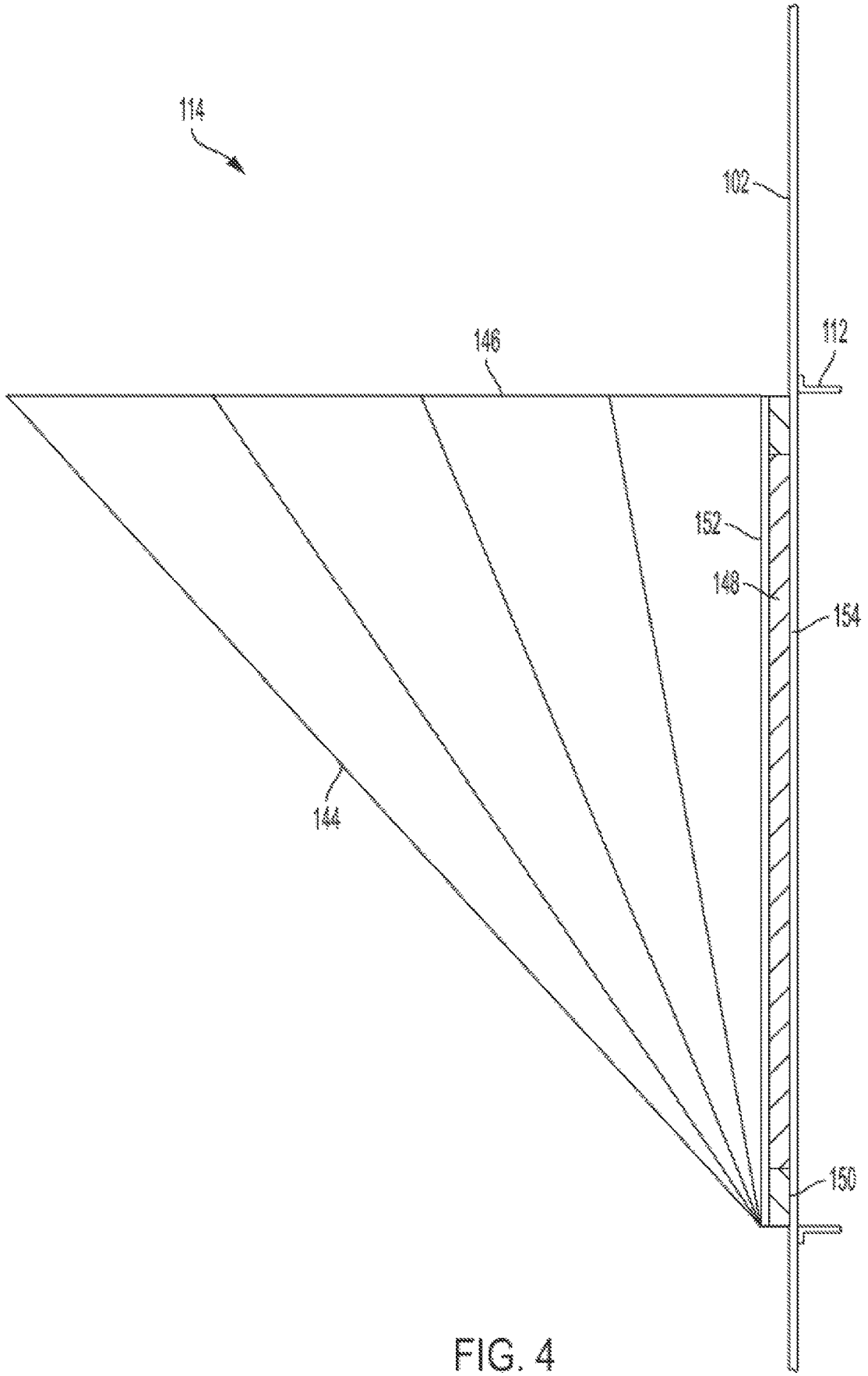
FIG. 4 illustrates an air inlet.

An air inlet 114 disposed on the interior of the booth may be configured to direct airflow from a blower upwards towards a ceiling of the booth. FIG. 4 illustrates an embodiment of an air inlet 114 that directs flow upwards. The inlet 114 includes a front baffle 144 that is disposed at an acute angle with respect to a vertical plane of the booth wall 102. The front baffle 144 may comprise a flexible or rigid polymeric material.

The front baffle 144 coupled to the wall by two symmetrical triangular sidewalls 146. The sidewalls 146 may comprise a flexible polymeric material. The sidewalls 146 may be pleated so that the front baffle 144 can be opened or closed, or adjusted between different orientations, without bunching up the sidewall material.

A filter 148 may be present in an air path between the blower and the interior of the booth. The filter may remove dust from air input into the booth, and may be a dust filter as known in the art.

The air inlet 114 may be secured to the tent wall 102 around a perimeter of the air inlet assembly by a fastener 150. In an embodiment, the fastener 150 is a removable fastener such as a zipper or a hook-and-loop fastener. In such an embodiment, the entire air inlet assembly may be removed from the tent wall to replace a filter 148 that is compressed between a first mesh panel 152 integrated with the assembly and a second mesh panel 154 that is integrated with the booth wall 102, and can be completely removed for ease of transport and replacement in case of damage. Removal for ease of storage and transportation is especially helpful when one or more element of the air inlet assembly comprises a rigid material.

The air inlet 114 may be disposed above a midpoint of the height of the walls of the booth. In some embodiments, the inlet is disposed 4 or more feet above the floor. For example, a midpoint of the air inlet 114 may be disposed 4, 5 or 6 feet above the floor 106 of the booth.

In another embodiment, one or more of the edges of the air inlet 114 may be affixed to the wall of the tent in a non-separable manner, e.g. by an adhesive or sewn seam. For example, three sides of a rectilinear air inlet assembly may be fixedly coupled to the wall, while one side is separable, thereby providing a sleeve that provides access to filter 148.

In other embodiments, the air inlet 114 that directs air upwards may have a different form from the embodiment of FIG. 4. For example, the air inlet may comprise a tubular element shaped like the exhaust tube 128 shown in FIG. 2. In such an embodiment, the inlet port may be disposed within one or two feet of the floor 106 of the booth.

An air inlet 114 that directs air flow upwards into the interior space of the booth provides several advantages. Spray booths are typically used in uncontrolled outdoor environments, so relatively large amounts debris may be present on the floor of the booth. Air entering the booth through the inlet has a higher velocity than air that circulates throughout the booth. Accordingly, when the inlet directs air downwards or horizontally, the air may stir the debris, which can negatively impact the quality of a paint job. Embodiments of the present application may limit the extent to which debris is disturbed within the booth by directing flow upwards within the tent.

Another advantage of an air inlet that directs airflow upwards is providing airflow that circulates through the booth. When air is directed upwards towards the ceiling of the booth, the air deflects off the ceiling and moves towards the middle of the booth. When the inlet is disposed towards the front of the booth and the outlet is disposed towards the back of the booth, the net effect of this combination of features is that air circulates throughout the interior of the booth.

In an embodiment, airflow may circulate from left to right sides of the booth in a generally cyclonic orientation and simultaneously move from the front of the booth towards the back of the booth, thereby passing through a majority of the open space within the booth. Put another way, airflow through the booth may follow a generally helical path, where a central axis of the helix is aligned with a front-back direction of the booth. The inventors have found that airflow in embodiments of the present application is surprisingly effective to provide even air movement throughout the booth without stirring dust from the floor, or creating significant pockets of lower or higher velocity airflow. It is difficult to provide a high-quality paint finish in the presence of significant deviations in airflow velocity within the booth, which are avoided by embodiments of the present disclosure.

Figure 5:
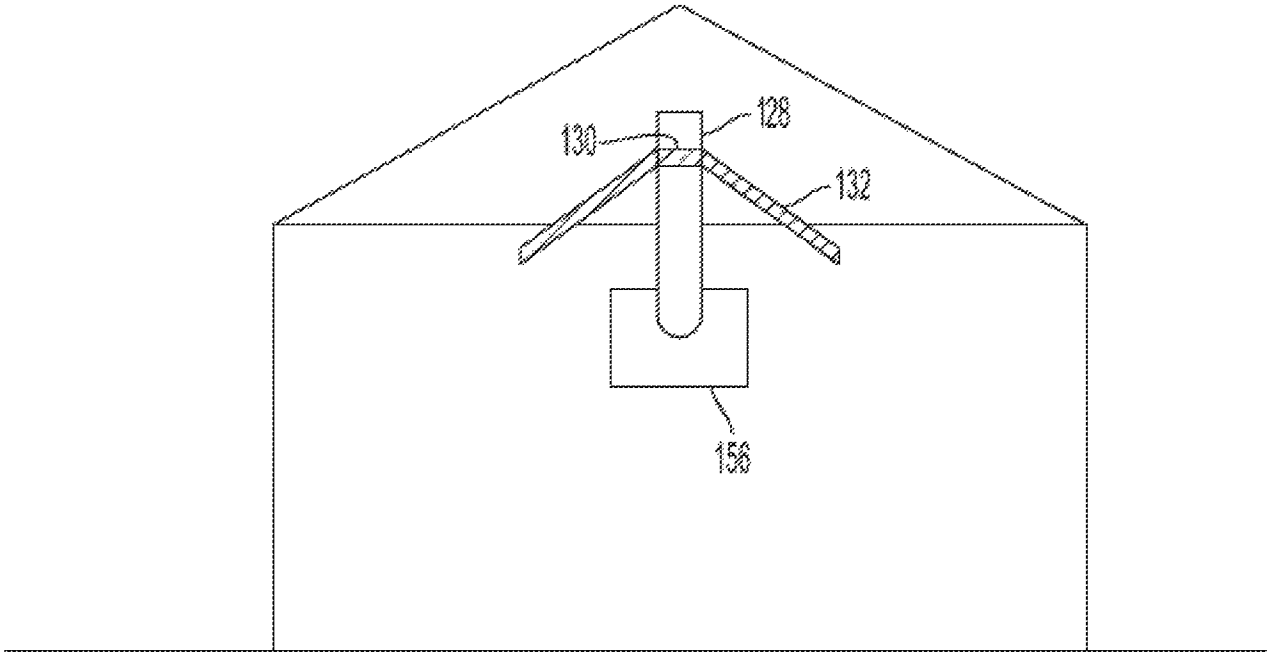
FIG. 5 shows an exhaust tube extending from a wall of the portable paint booth.

FIG. 5 illustrates an embodiment of a wall of the booth 100. In the embodiment of FIG. 5, the exhaust tube 128 is disposed in the middle of the wall in a horizontal direction. The wall may be a side wall, a rear wall, or a front wall. A filter enclosure 156 is coupled to the exhaust tube, and retains a filter that filters the exhausted air before it is released to atmosphere. The filter enclosure 156 may be similar to the filter arrangement in the air inlet 114—that is, the filter enclosure 156 coupled to the exhaust tube may be separable from a wall of the booth by a removable panel, or may have one or more side that is individually separable from the wall of the booth. The filter may be compressed between two mesh panels, and the filter may be replaceable from inside the booth or from outside the booth.

The embodiment of FIG. 5 shows two symmetrical straps 132 that are arranged on left and right sides of the exhaust tube 128. Such an arrangement may be helpful to stabilize the exhaust tube against wind that blows from the left or right side of the booth with respect to the orientation shown in the figure. Although the terminal end of the exhaust tube 128 in FIG. 5 is below the highest point of the roof of the booth, in another embodiment, the terminal end of the exhaust tube is disposed 6 feet or more above the highest point of the roof. In such an embodiment, the exhaust tube 128 may be supported by an external support structure such as rigid pole 172 that extends between a ground surface and along a vertical section of the exhaust tube, thereby preventing the exhaust tube from collapsing under its own weight and stabilizing the exhaust tube in the presence of wind.

Figure 6:
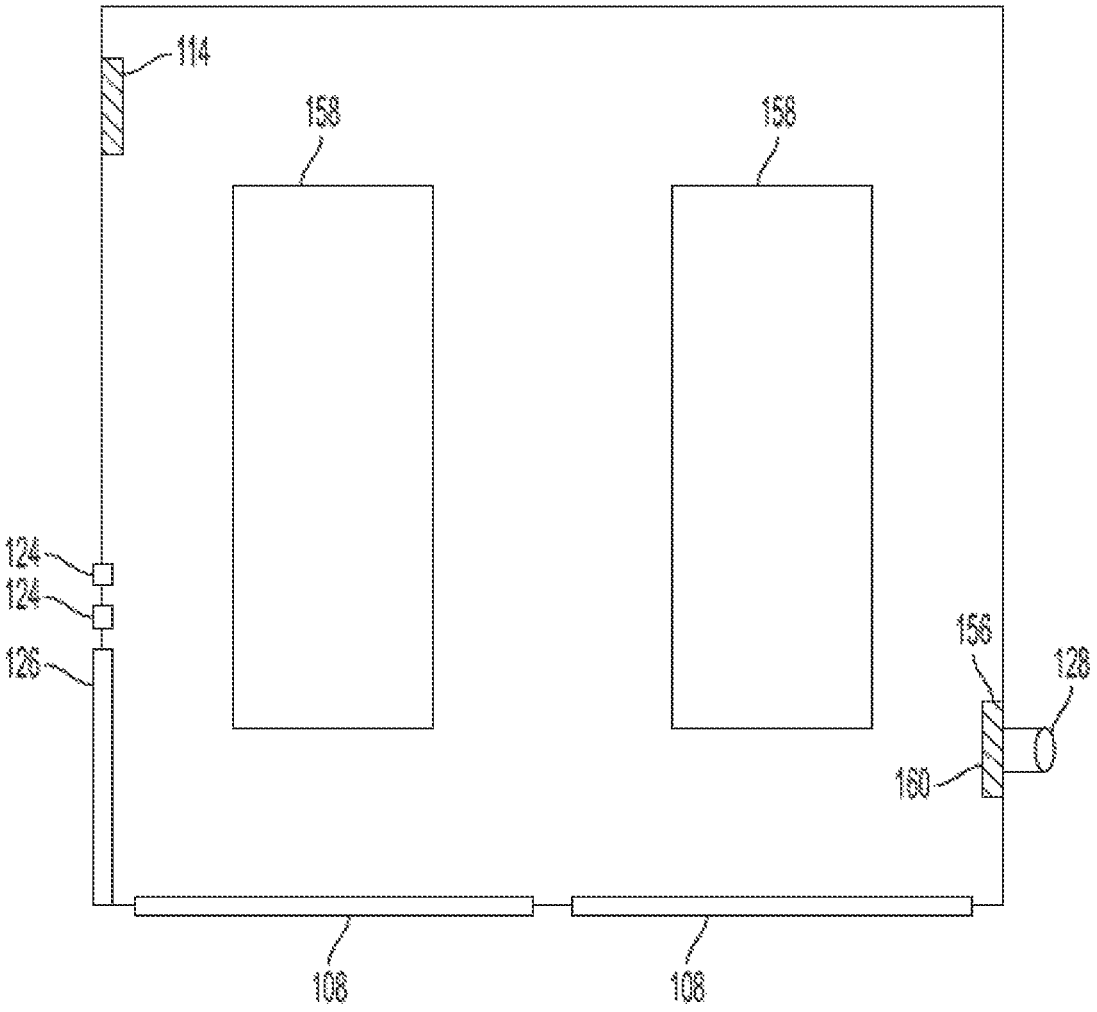
FIG. 6 is a plan view of the portable paint booth.

FIG. 6 is a plan view of a portable spray booth in which two vehicles 158 are parked in the booth. In an embodiment, the booth occupies an area of 400 square feet or less. Accordingly, when the booth has a square footprint, each side of the booth may be 20 feet long. In a booth of this size, two vehicles can be parked side-by-side within the booth with sufficient space for a painter to move around the vehicles. However, the booth is not limited to these dimensions—in other embodiments, the booth may have one or more wall that is longer or shorter than 20 feet. For example, a booth may be 10 feet in either dimension, and in one embodiment the tent is 40 feet wide and 10 feet deep. Such an embodiment may be useful for painting only a portion, e.g. a bumper, of a vehicle, and could accommodate several vehicles at a time.

As seen in FIG. 6, the air inlet 114 is located towards the rear of the booth. When the inlet is oriented on a side wall towards the rear of the booth and an exhaust port 160 is located along the opposing side towards the front of the booth, air circulates throughout the entire interior of the booth. In such an embodiment, airflow may circulate through the booth before exiting through the exhaust tube 128 on an opposite side of the tent from the air inlet 114.

The air inlet 114 may be oriented in the rear third of the booth, the rear quarter of the booth, the rear 15% of the booth, or the rear 10% of the booth. For example, if a booth is 20 feet from front to back, a center of the air inlet 114 may be disposed no more than about 7 feet, 5 feet, 3 feet or 2 feet from the rear wall of the booth.

Locating the air inlet 114 on the same wall as side door 126 has several advantages. One advantage is that the blower 110 (not shown in the embodiment of FIG. 6) can be located adjacent to a work vehicle that is parked adjacent to the side door 126. Accordingly, the blower 110 (not shown in the embodiment of FIG. 6) can be powered by a power source inside the work vehicle, such as a battery or generator, with a relatively short power connection. Another advantage is that the blower 110 (not shown in the embodiment of FIG. 6) can be positioned under the side cover 116, reducing the chance that the blower and associated electrical connections would become wet in the event of precipitation. In one configuration (not shown), the blower 110 is disposed within the work vehicle itself, and input duct 112 may run from the vehicle to the booth, further reducing the chance that the blower could get wet.

Figure 7:
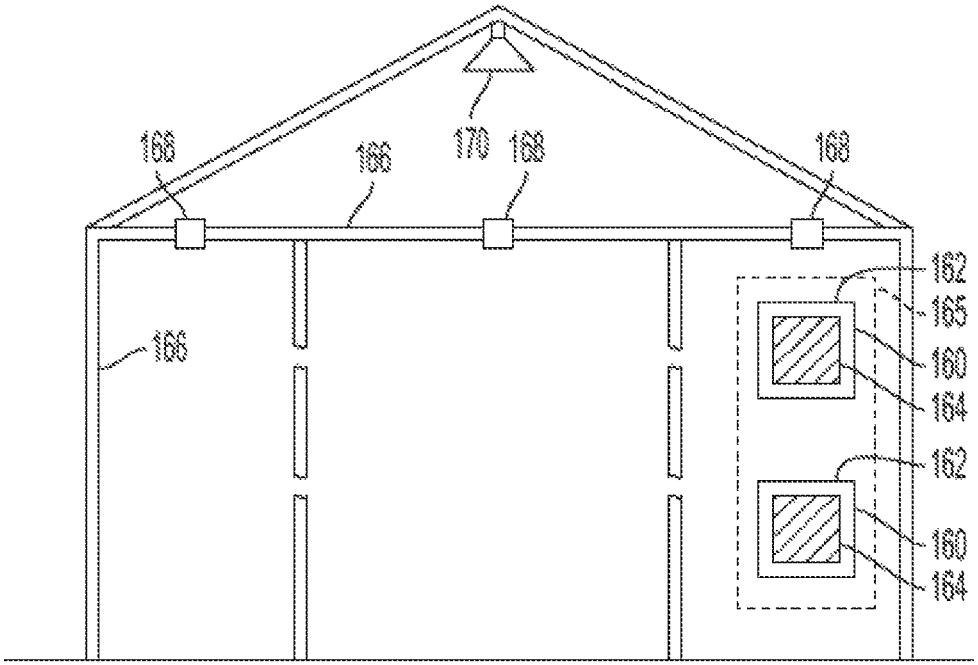
FIG. 7 is a cross-sectional view showing exhaust ports in a wall of the paint booth.

FIG. 7 is a cross-sectional view of a paint booth. Two exhaust ports 160 are disposed in a side wall of the booth, and when the booth is pressurized, air flows out of the exhaust ports and inflates the exhaust tube 128 that is in fluid communication with the exhaust ports. In an embodiment, the surface area occupied by the exhaust ports 160 is greater than the surface area of the air inlet 114. For example, the exhaust ports 160 may occupy an area of a wall of the spray booth that is two times, three times or more than the area occupied by the air inlet 114.

Aspects of each exhaust port 160 may be similar to aspects of the air inlet 114. In particular, a perimeter of an exhaust port may be secured to a tent wall, and one or more edge of the exhaust port may be removable to provide access to an exhaust filter disposed between two mesh panels. The perspective of FIG. 7 illustrates perimeter material 162 disposed around edges of the exhaust port that may be permanently or removably attached to the wall, and a first mesh panel 164 that faces the inside of the booth. In addition, each exhaust port 160 may have a selective blocking element 161 comprising a barrier material that is securable to the perimeter material 162, for example by hook-and-loop attachment. In such an embodiment, the selective blocking element 161 may be attached to the perimeter material to cover all or a portion of each exhaust port 160, providing control over a total exhaust surface area of the booth.

The booth may be supported by poles 166 that are rigid structural elements. For example, the poles 166 may be a metal or rigid polymer material, and the poles may be rigidly coupled to one another by bolts, pins, friction joints, etc. The poles may be coupled to the flexible polymeric roof and wall materials by a plurality of cuffs 168, which may be secure to the poles by straps or hook-and-loop elements. In addition, one or more light 170 may be coupled to the poles. The exact number and size of poles may differ between embodiments.

When air is provided to the booth from the mechanical blower 110, the booth will be in a positive pressure condition with respect to atmosphere. The booth may be operated to provide at least five air turns per hour, more than one turn per minute, etc., and the size of the blower, inlet port and outlet port and associated air paths may be adapted to achieve an amount of air turns for a particular interior geometry. In addition, the booth may operate with 98% capture efficiency.

Figure 8:
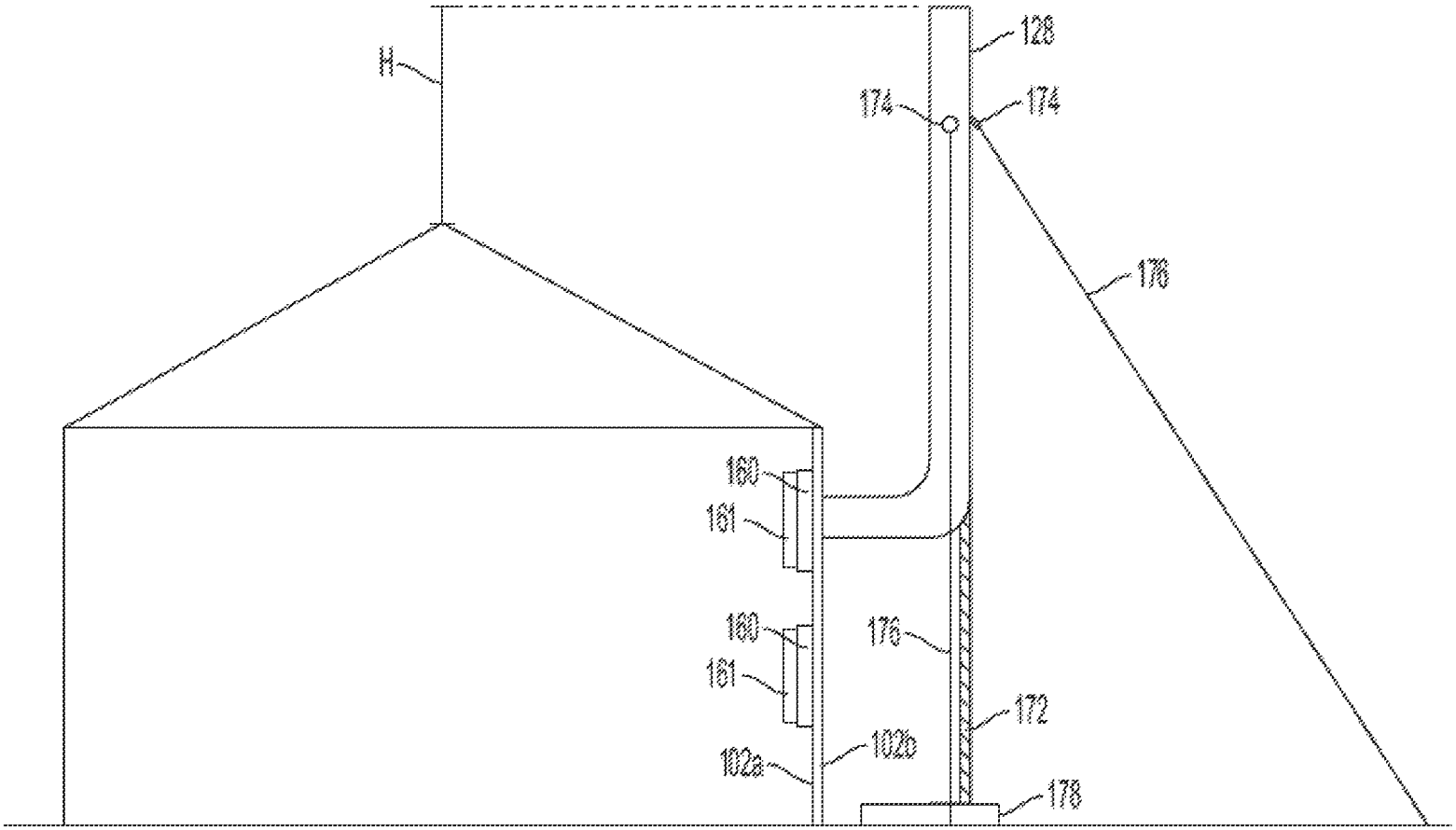
FIG. 8 illustrates an exhaust system of a portable paint booth including an exhaust tube supported by a support post.

FIG. 8 illustrates an embodiment of a portable spray booth 100 in which the exhaust port extends a predetermined height H above the peak, or the highest point, in the roof 104 of the spray booth. A support post 172 may run from ground level to the terminal end 142 of the exhaust tube 128, and provide vertical support for the exhaust tube. In some embodiments, the air pressure of exhaust air flowing through the exhaust tube 128 is not sufficient to maintain the tube in a vertical orientation, and in such instances, the support post 172 provides or supplements vertical support for the tube. Maintaining the vertical orientation can be advantageous to ensure that exhaust fumes exit the exhaust tube 128 at a level that minimizes the chance that the fumes would re-enter the tent, and/or a height that reduces the probability that persons on the ground would be exposed to the fumes. Examples of height H include one foot, four feet, six feet, eight feet, and ten feet.

The embodiment in FIG. 8 includes one or more attachment point 174 coupled to the exhaust tube 128. Tie-down straps 176 may be attached between each attachment point and a stable location (such as a stake in the ground, a building, an object or a vehicle) in order to provide lateral stability to the exhaust tube 128, which may prevent the exhaust tube from falling to one side, especially in the presence of wind.

In an embodiment, the support post 172 is supported by a weighted base 178. In other embodiments, the support post 172 may be slotted into a hole in the ground, driven into the ground, or supported by being affixed to a structure such as a building or a fence or affixed to a vehicle. Accordingly, the support pole may be supported by a stable structure that is at least one of a ground, a structure, a weighted base, and a vehicle.

The exhaust system shown in FIG. 8 includes two exhaust ports 160 that are coupled to an inner wall 102*a*. The exhaust port 160 is coupled to an outer wall 102*b*, so that air can flow from both exhaust ports 160 into the exhaust tube 128. An area around the exhaust ports 160 may be sealed, so that the space between the inner and outer walls 102*a* and 102*b* acts as a manifold 165 (shown in FIG. 7) that collects air from both ports and directs the air into the exhaust tube 128. Accordingly, an embodiment of the booth may employ multiple standard sized filters in parallel in the same exhaust path, thereby providing an adequate surface area for the exhaust path without requiring expensive, custom made filters.

A selective blocking element 161 may be coupled to each exhaust port. The selective blocking elements 161 may comprise a flexible non-porous polymeric sheet that is detachably coupled to the perimeter 162, e.g. by zippers or hook-and-loop strips, so that the size of each exhaust port 160 can be adjusted to adjust flow to the exhaust tube 128 depending on the size of the blower 110, the porosity of filters, and other variable conditions. In an embodiment, a lower seam of the selective blocking element 161 is attached to the wall of the booth, e.g. by an adhesive, sewn or melt bond, and straps are present to secure the selective blocking element in a rolled orientation when the selective blocking element is not in use.

Figure 9:
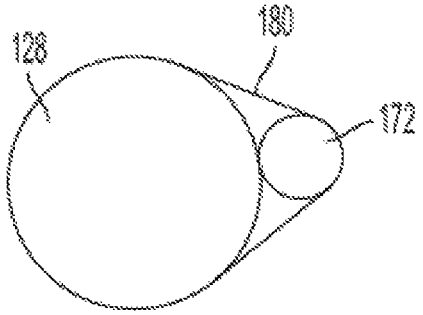
FIG. 9 is a cross-sectional view of an exhaust tube with a sheath and support post.

The support post 172 may be coupled to the exhaust tube 128 by one or more strap, or one or more loop disposed on an outer surface of the exhaust tube 128. FIG. 9 shows a cross-sectional view of the exhaust tube 128 in which an outer sheath 180 is attached to a perimeter of the exhaust tube 128, and the support post is disposed within the outer sheath 180. In an embodiment, the outer sheath 180 may extent along most or all of the vertical portion or third section 138 of the exhaust tube so that the tube is supported along the entire vertical portion.

The outer sheath 180 may be a single sleeve that runs along the vertical portion of the exhaust tube 128, and may have an enclosed far end that is adjacent to the terminal end 142 of the exhaust tube 128. Such a configuration is advantageous for its ease of manufacturing and assembly—for example, a painter can assemble the support post 172 with the exhaust tube 128 by sliding the post into the opening between the sheath 180 and the exhaust tube 128 and slide the post until it is stopped by the enclosed far end. In some embodiments, in an assembled orientation, the far or top end of the support post 172 is disposed towards the terminal end 142 of the exhaust tube 128, e.g. within a foot of terminal end, or adjacent to terminal end, to ensure that the terminal end does not collapse, thereby obstructing openings 140.

Figure 10:
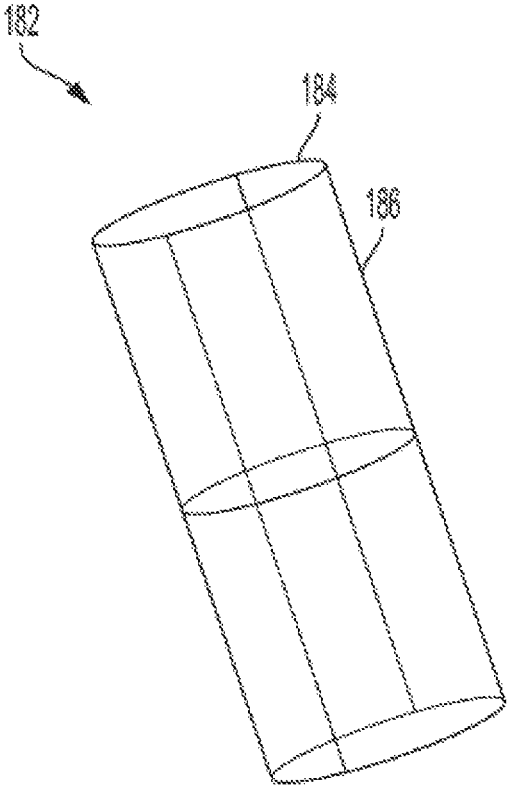
FIG. 10 illustrates a support structure.

FIG. 10 illustrates an embodiment of a support system 182 that may be used to support an exhaust tube 128. An exhaust tube 128 that is constructed of a polymeric sheet material may benefit from structural supports that can, for example, maintain an open orientation of the exhaust tube in the presence of wind.

The support system 182 shown in FIG. 10 includes a plurality of perimeter elements 184 that are coupled together by struts 186. The perimeter elements 184 and struts 186 may be constructed of a rigid material such as a metal or plastic. In some embodiments, the support system 182 may comprise a metal wire mesh. The support system 182 may be disposed inside or outside of the tube, and coupled to the tube by, for example, a sewn seam or an adhesive bond.

Embodiments are not limited to the configuration shown in FIG. 10. In one embodiment, the support system 182 comprises a single perimeter element 184 that is disposed at the terminal end 142 of the exhaust tube 128. A perimeter element 184 at the terminal end 142 can prevent the terminal end from becoming bunched up or collapsing, ensuring that the openings 140 are not obstructed by the tube material. In another embodiment, a support system 182 comprises a plurality of perimeter elements 184 disposed along the exhaust tube 128, which may prevent sides of the tube from collapsing. In such an embodiment, the support post 172 may provide support in the axial direction of the tube.

Embodiments of the present disclosure have several advantages over conventional booths. Embodiments of the present disclosure can be assembled by a single individual within about an hour, and disassembled in even less time. Accordingly, it is practical to employ a portable spray booth described by this disclosure for relatively limited jobs, such as painting a portion of a single vehicle. This tilts the economics of the automotive finishing industry, reducing the costs of assembling the booth relative to the cost of towing a vehicle, which opens up markets that are not available using conventional technologies.

An embodiment of operating a portable spray booth may include one or more of erecting walls and a roof of the spray booth using a plurality of poles, attaching a floor to walls, attaching walls to a roof, coupling a mechanical blower to an air inlet in a wall of the booth, supporting an exhaust tube using a vertical support member and one or more lateral support member, inserting a first filter at the air inlet, inserting a second filter into an exhaust path at an exhaust port in fluid communication with the exhaust tube, activating the mechanical blower to inflate the booth and provide air that flows into the booth and out one or more orifice at a terminal end of the exhaust tube, and painting an object within the booth, wherein fumes from the paint exit the booth through the exhaust tube. The fumes may exit the exhaust tube above the roof, and at a point 6 feet or more above the roof. The exhaust may flow through two exhaust ports into a manifold between first and second walls of the booth before entering the exhaust tube.

Although embodiments of the present disclosure have been explained in the context of painting vehicles, the booth may be used for other purposes. For example, the portable booth can be used to paint objects other than vehicles, and to conduct activities for which it is desirable to provide well-circulated air flow in a portable structure, including activities in which it is desirable to filter air that enters and/or exits the booth.

What is claimed is:

1. A portable paint booth comprising:

a floor;

a roof;

walls;

at least one door disposed in a front wall of the booth;

an air inlet adapted to receive air input into the booth from a mechanical blower to pressurize the booth with a positive pressure; and an exhaust tube that extends from the booth and comprises at least one orifice disposed at a terminal end of the exhaust tube, wherein the terminal end of the exhaust tube is disposed above a junction of at least one of the walls and the roof of the booth when the booth is pressurized and wherein the floor, the roof and the walls of the booth comprise flexible polymeric materials, and the roof and the walls are supported by rigid poles.

2. The portable paint booth of claim 1, wherein the exhaust tube comprises a first section that extends outwards from one of the walls of the booth, a second section directs the exhausted air to a vertical axis, and a third section that conveys exhausted air along the vertical axis to exit through the terminal end of the exhaust tube.

3. The portable paint booth of claim 2, further comprising:

a support pole that vertically supports the exhaust tube, wherein the support pole is coupled to and extends along an entire length of the third section of the exhaust tube, and the support pole is anchored to a stable structure.

4. The portable paint booth of claim 2, further comprising:

a support system that supports the third section of the exhaust tube, the support system comprising at least one perimeter element that extends around a perimeter of the exhaust tube and maintains a portion of the exhaust tube in an open orientation.

5. The portable paint booth of claim 4, wherein the at least one perimeter element comprises three or more perimeter elements that are spaced apart from one another.

6. The portable paint booth of claim 2, wherein a body of the exhaust tube comprises a flexible polymeric material.

7. The portable paint booth of claim 6, further comprising:

a support system coupled to the exhaust tube, the support system including at least one perimeter element disposed at the terminal end of the exhaust tube, wherein the perimeter element extends around a perimeter of the exhaust tube and keeps the terminal end of the exhaust tube in an open orientation.

8. The portable paint booth of claim 1, wherein the exhaust tube extends at least six feet above the highest point of the roof.

9. The portable paint booth of claim 1, wherein the roof is separable from the walls, the walls are separable from the floor, and the floor occupies an area of 400 square feet or less.

10. The portable paint booth of claim 1, wherein the air inlet is an air inlet assembly that includes an inlet filter compressed between two mesh panels.

11. The portable paint booth of claim 1, wherein the exhaust tube is coupled to a manifold comprising an inner layer and an outer layer of the first side of the booth, and an entrance to the manifold is an exhaust port in the inner layer.

12. The portable paint booth of claim 11, wherein the exhaust port comprises at least one filter compressed between two mesh panels, and a selective blocking element that can be adjusted to selectively block a portion of the exhaust port.

13. The portable paint booth of claim 1, wherein the floor, the roof and the walls all comprise non-porous materials so that an internal volume of the booth inflates with air when the mechanical blower is in operation and the air exits the paint booth through the orifices in the terminal end of the exhaust tube.

14. The portable paint booth of claim 1, wherein the exhaust tube has a cylindrical shape, and the terminal end of the exhaust tube comprises a sheet of material having a plurality of orifices through which air exits the exhaust tube.

15. The portable paint booth of claim 1, further comprising:

a side cover with a first end that is coupled to the booth above a side door in a first side wall of the booth and a free end opposite to the first end.

16. The portable paint booth of claim 15, wherein the air inlet and the side door are disposed in the first side wall, and the exhaust tube extends from a second side wall that is on an opposite side of the paint booth from the first side wall.

17. A portable paint booth comprising:

a floor;

a roof;

front, rear and side walls;

at least one door disposed in the front wall of the booth;

an air inlet adapted to receive air input into the spray booth from a mechanical blower to pressurize the booth with a positive pressure;

an exhaust tube that extends from the booth and comprises at least one orifice disposed at a terminal end of the exhaust tube, wherein the terminal end of the exhaust tube is disposed above a junction of at least one of the walls and the roof of the booth;

a support pole that vertically supports the exhaust tube; and at least one perimeter element that extends around a perimeter of the exhaust tube and maintains a portion of the exhaust tube in an open orientation, wherein the floor occupies an area of 400 square feet or less, and the exhaust tube extends at least six feet above the highest point of the roof, and wherein the floor, the roof and the front, rear and side walls of the booth comprise flexible polymeric materials, and the roof and the walls are supported by rigid poles.

* * * * *